US005213156A

United States Patent [19]

Eriksson

[11] Patent Number: 5,213,156

[45] Date of Patent: May 25, 1993

[54] HEAT EXCHANGER AND A METHOD FOR ITS FABRICATION

[75] Inventor: Rune Eriksson, Linköping, Sweden

[73] Assignee: Elge AB, Linkoping, Sweden

[21] Appl. No.: 873,621

[22] Filed: Apr. 23, 1992

Related U.S. Application Data

[63] Continuation of Ser. No. 634,568, Dec. 27, 1990, abandoned.

[30] Foreign Application Priority Data

Dec. 27, 1989 [SE] Sweden ..... 8904369
Apr. 2, 1990 [SE] Sweden ..... 9001194

[51] Int. Cl.[5] ..... F28D 7/02

[52] U.S. Cl. ..... 165/163; 165/158; 165/177

[58] Field of Search ..... 165/158, 159, 163, 177; 228/183

[56] References Cited

U.S. PATENT DOCUMENTS

| | | | |
|---|---|---|---|
| 514,338 | 2/1894 | Row | 165/177 |
| 1,655,086 | 1/1928 | Blanding | 165/163 |
| 1,922,838 | 8/1933 | Bossart | 165/177 |
| 1,963,906 | 6/1934 | Jaffe | 165/183 X |
| 2,081,043 | 5/1937 | Kuhni | 165/154 |
| 2,646,620 | 7/1953 | Geddes et al. | 228/183 |
| 3,256,932 | 6/1966 | Schlichting | 165/163 |
| 3,316,961 | 5/1967 | Dorner | 165/163 X |
| 4,332,294 | 6/1982 | Drefahl et al. | 165/157 |
| 4,989,670 | 2/1991 | Foley | 165/143 |

FOREIGN PATENT DOCUMENTS

| | | |
|---|---|---|
| 0146817 | 6/1986 | European Pat. Off. . |
| 342959 | 11/1989 | European Pat. Off. . |
| 1501684 | 6/1969 | Fed. Rep. of Germany . |
| 2608623 | 9/1977 | Fed. Rep. of Germany . |
| 3042983 | 9/1982 | Fed. Rep. of Germany . |
| 79026 | 9/1962 | France . |
| 1523859 | 3/1968 | France . |
| 2392349 | 12/1978 | France . |
| 2404187 | 4/1979 | France . |
| 460829 | 10/1968 | Switzerland . |
| 653431 | 12/1985 | Switzerland . |
| 1200416 | 7/1970 | United Kingdom . |
| 2197942 | 6/1988 | United Kingdom . |
| 8909368 | 10/1989 | World Int. Prop. O. . |

*Primary Examiner*—Allen J. Flanigan
*Attorney, Agent, or Firm*—Cushman, Darby & Cushman

[57] ABSTRACT

A heat exchanger for transferring heat between an inner and outer medium with a tube bundle for transporting the inner medium. The tube bundle being a plurality of tubes forming concentric rings of tubes. The tubes have angular progressions and are corrugated their entire length; thus adjacent tubes can contact without fatally increasing mechanical tensions. A shell surrounds the tube bundle. An inner medium connector transports the inner medium to and from the tube bundle. An outer medium connector transports the outer medium to and from the shell; the outer medium flowing around the tube bundle inside the shell.

15 Claims, 4 Drawing Sheets

HEAT EXCHANGER AND A METHOD FOR ITS FABRICATION

This is a continuation of application Ser. No. 654,568, filed on Dec. 27, 1990, which was abandoned.

BACKGROUND OF THE INVENTION

This invention is related to heat exchangers of the kind that include pipes or tubes extending between two tube plates, and with one fluid streaming inside the tubes and another outside the tubes. The tube package or heat exchanger core is surrounded by a shell.

One problem with a heat exchanger of this kind is that the tubes when heated will expand causing considerable tension in the tubes, tube plates, and the shell. This is sometimes enhanced further by the use of different materials for the tubes and sheli. These tensions in turn will shorten the life span of the heat exchanger.

In order to diminish these tensions it is known to arrange the tubes with angular progression between the two plates. Slightly spirally or helical progressions are shown in the U.S. Pat. No. 1,655,086. The helical shape or angular progression will provide a resilience to core and the tension will be reduced. However these heat exchangers have a tendency to become rather expensive to manufacture due to the great number of steps and amount of manual labor necessary to produce each heat exchanger.

The object of the invention is to provide a heat exchanger with an angular progression for the tubes that can be manufactured simply and with a minimum amount of manual labor. It is also the object of the invention to provide a space efficient heat exchanger. Since heat exchangers with more or less straight tubes and tube plates at each end tend to be less space efficient than other types, and for many appliances they become unpractically long.

SUMMARY OF THE INVENTION

This object is achieved by using tubes corrugated in the direction of their length and corrugated over their entire length except for the ends. This will improve fluid flow on the outside of the tubes so much that the tubes can contact each other their entire length. The corrugations will improve turbulence in- and outside of the tubes and will also improve heat transfer.

Another object of the invention is also to provide a simple manufacturing method for this type of heat exchanger. This is achieved by arranging straight tubes ring- or cylinderwise and then turning each cylinder or ring of tubes in one simultaneous motion. Preferably the heat exchanger is constituted by several concentric rings of tubes, that can be turned in the same direction or in different directions. Preferably each ring is turned separately beginning with the innermost ring. In order to have tubes with identical length and thus identical inner flow resistance the inner tube circles have a greater progression or turning angle than the outer tubes. When the rings of tubes are turned the diameter of the tube circles tend to diminish and a good grip is therefor achieved by the inner circle on a center core tube, and for the outer circles on the inner ones. In this way a very compact packing of tubes in the heat exchanger can be achieved in a simple manner, and this tube package will even hold together an its own accord when released from the machine that turns the tube circles.

When the tube package or core has been manufactured, the ends of the bundle are machined to the desired shape (normally flat). The tube ends are then expanded so that no space will be left, and the tubes can then be welded or soldered to each other so that a tube plate is achieved. Expansion and soldering can be carried out ringwise, simultaneously, or in a close timed sequence.

In fabrication the tubes can be located on two rings of axially directed pins. When each tube in a ring is in place, it is turned and given its intended angular progression. At the same time the length of the tube is correspondingly reduced. Then the next circular set of pins is used to set up the next layer etc. The locating of the tubes can be done by hand or by a simple robot. The demands on precise fabrication is reduced in relation to the known art and the inventive method will thus provide a cost efficient fabrication method and a space efficient heat exchanger.

BRIEF DESCRIPTION OF THE DRAWINGS

Further advantages and characteristics of the invention are apparent from the following description of preferred embodiments shown in the drawings.

EMBODIMENTS OF THE INVENTION

Figure 1:
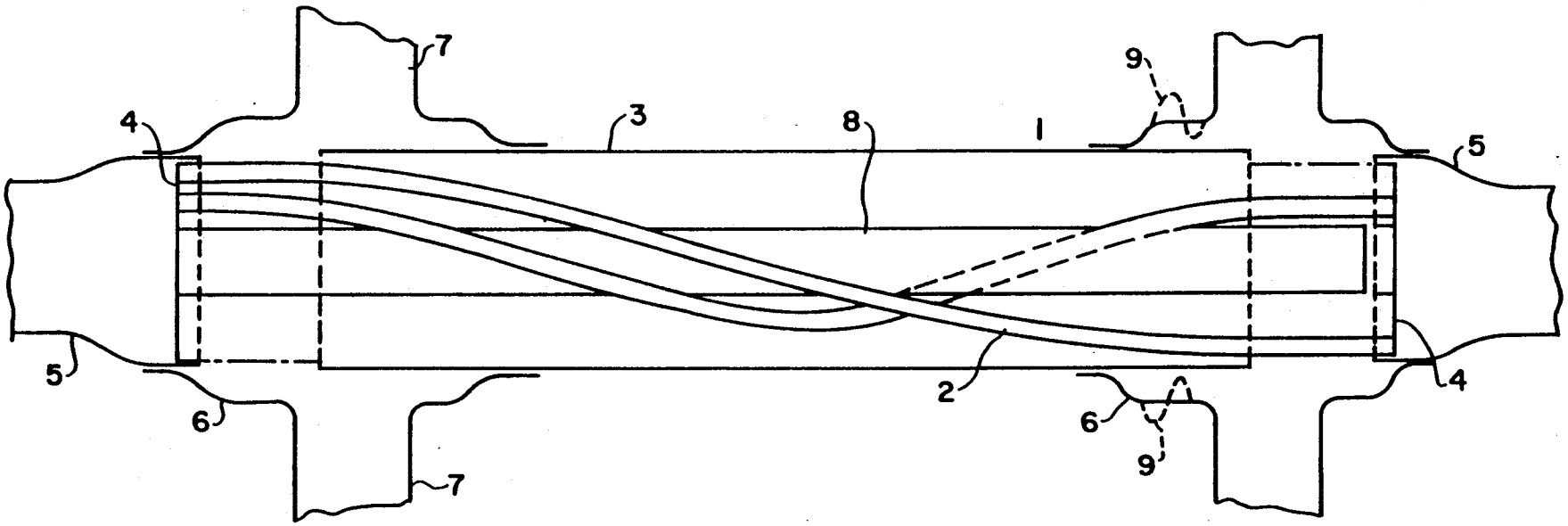
FIG. 1 shows schematically a heat exchanger in accordance with the invention.
Figure 2:
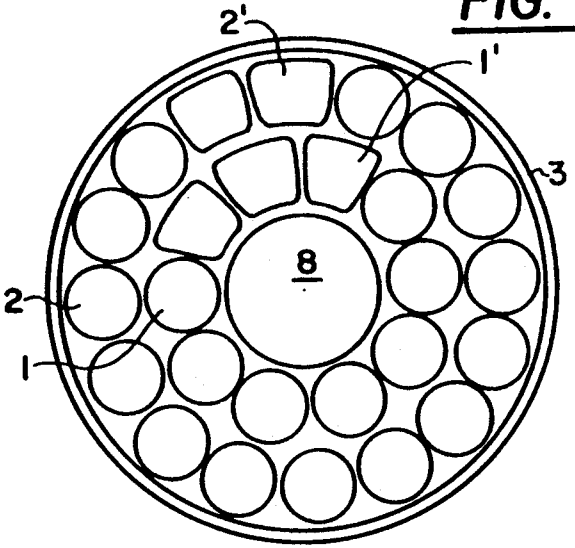
FIG. 2 shows the tube plate end of a tube bundle.

The heat exchanger shown in FIGS. 1 and 2 includes two concentric circles of corrugated tubes. The inner tubes have been designated by 1 and the outer by 2. The tubes 1 and 2 have their ends widend as is shown in FIG. 2 for tubes $1^1$ and $2^1$ in dashed lines so that they contact each other. Those tubes are then soldered to each other, constituting a tube plate. At each end of the heat exchanger a distributing/collecting connection 5 is arranged over the two plates 4 for transporting the inner entering/leaving medium to be led through the tubes. The bundle of tubes are further surrounded over a greater part of their length by a shell 3. The shell 3 is provided with connections 6 surrounding the shell, and connections 7 for transporting the outer entering/leaving medium that is to stream around the tubes inside the shell. As is apparent from FIG. 1, shell 3 extends a short distance into the connections 6. Thus, the outer entering/leaving medium will be distributed around the tube bundle more efficiently than if the shell only had extended to the connections 6. This reduces the risk of internal heat differences and tension in the tubes.

In FIG. 1 only one tube of each circle of tubes has been shown in order to clearly depict the angular progression or helical shape of the tubes. The tubes are not only helical in different directions but the pitch is somewhat different for each circle. The inner tube 1 has been turned more than the outer tube 2 in order to insure that the tube lengths of the tubes 1 and 2 coincide resulting in equal flow resistances inside the tubes.

The arrangement of the tubes will insure a good turbulence around the tubes, and since tubes will enter one location in one tube plate and come out at another location at the other tube plate possible laminations in the entrance flow will effectively be broken up, thus enhancing performance.

Since it would be difficult to provide tubes in the center with a sufficient turning to achieve the necessary resilience and length, a blind tube 8 is located in the center. The only object of blind tube 8 is to fill up a certain space in the heat exchanger. Blind tube 8 can be connected either via a tube plate to the inner medium or provided with openings towards the outer medium surrounding the tubes. The blind tube 8 is however only fastened to one tube plate, so that the possible movements of the heat exchanger core are not hindered by this tube.

Figure 6:
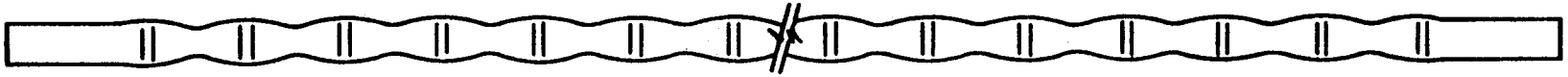
FIG. 6 shows an embodiment of the tube as used in the invention.

When fabricated, the heat exchanger tubes 1 and 2 are turned ringwise. As shown in FIG. 6, tubes are corrugated lengthwise Furthermore, the tubes can be compressed laterally in alternating directions, preferably by 90° thus, giving an alternating of the tubes. In other words, the tubes are alternately flattened in a direction transverse to the axial direction of the tube and in a direction in the axial direction of the tube. This improves the turbulence inside the tubes and contributes to an increased heat exchange. Furthermore flow conditions outside the tubes will be improved and the flow resistance for the outer medium will be reduced.

When turning each ring of the heat exchanger tubes a stable shape will be achieved for each ring and if one starts with the inner ring this will contract and grip efficiently around the centre blind tube. The consecutive outer ring of tubes 2 will then be contracted and press against the inner ring of tubes 1. The turning of the rings effectively diminishes the diameter of the tube circles, thus inherently pressing the tubes tightly against the blind tube 8 or the inner tube circle, and also inherently adjacent tubes in the same tube circle contact each other. Tools for turning the tubes or rather the rings of tubes will, while turned, move the same distance axially whereas the turning angle will differ. The tools used can with very small alterations be used for several different tubes and lengths of heat exchangers. Preferably the different rings are turned in alternating directions. By turning the rings separately the total torque that has to be applied is kept at a low level and the tools can be made simpler.

Since the different rings of tubes in a heat exchanger core are only given such an angular progression that equal length is achieved despite different diameters the machinery for turning the rings of tubes can be controlled to turn each ring until a preset final length of the core is reached. In this way one does not have to calculate the progression angle, instead the final length controls the degree of progression for each ring of tubes.

A ring of tubes turned as indicated above will be stable even without an inner core. Thus, the different rings can be fabricated separately and then brought together. Since the ring of tubes contracts upon turning, the ends of the tubes will have a larger diameter than the tube bundle. Therefore, before soldering the tubes to each other the ends of the tube bundle are compressed to the diameter of the bundle so that a close fitting shell can be used.

Figure 3:
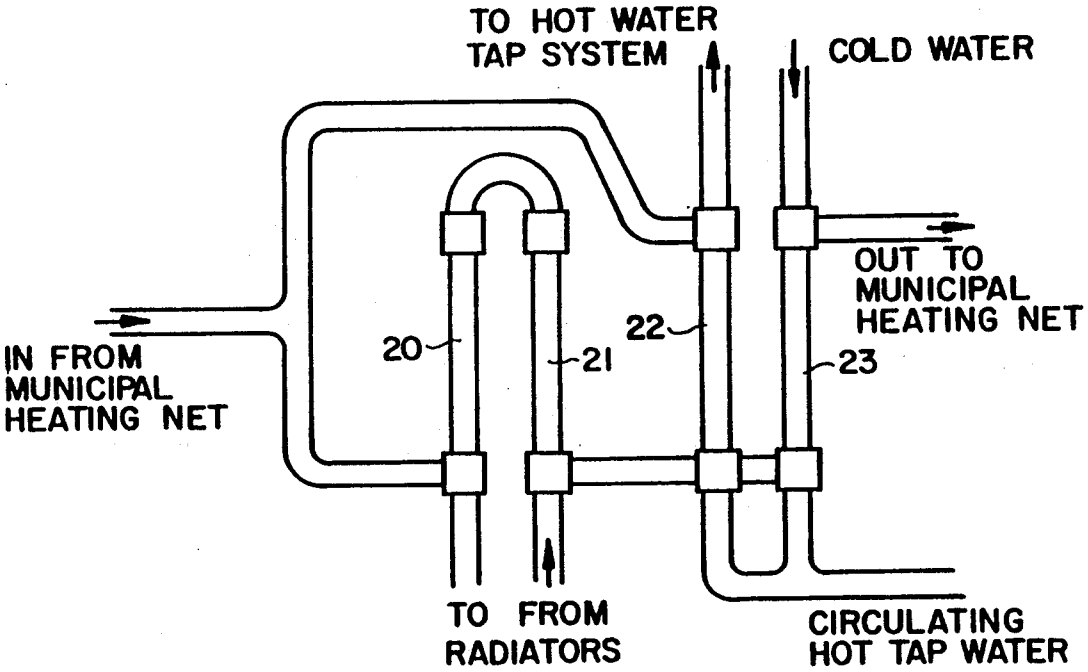
FIG. 3 shows schematically a coupling scheme of heat exchangers in accordance with the invention used in a device at a municipal heating network
Figure 4:
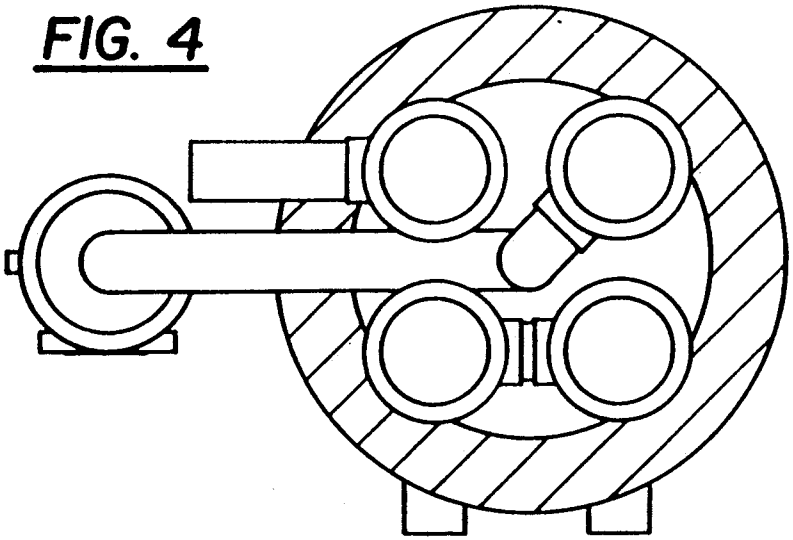
FIGS. 4 and 5 show the compact actual arrangement of the device.
Figure 5:
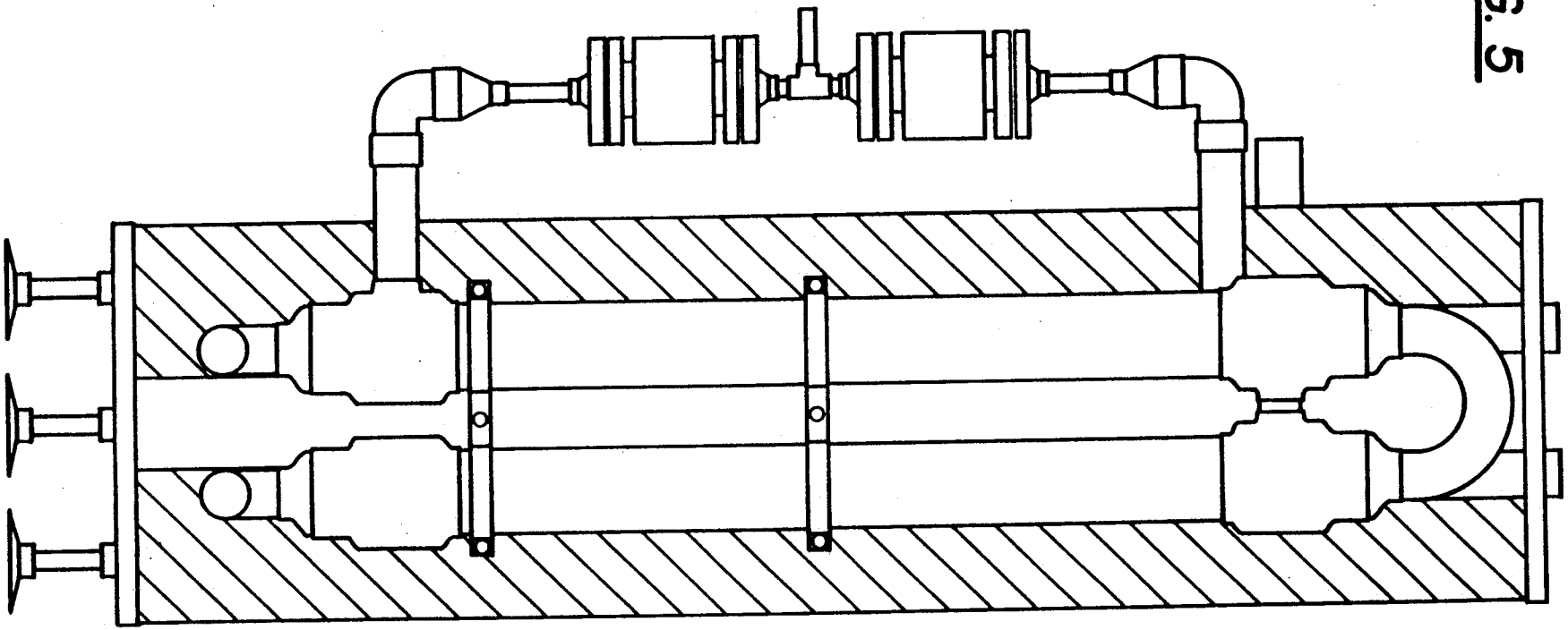

With the shown construction of the shell 3 and the connections 6, the connection 6 can be used to by-pass the heat exchanger with yet another heat exchanger since a flow across and through the connections 6 past the tubes will have very little influence on a efficiency of the heat exchanger. This will in turn faciliate the building of very compact heat exchanger cores, as for instance are used in individual houses in a municipal heating not work. This is shown in FIGS. 3, 4 and 5, and described below.

The bellowlike dashed part 9 between the shell 3 and the connection 6 further improves the resilience of the care so that the heat exchanger can cope even better with possible heat tensions that can result between the tube bundle and the heat exchanger shell.

The use of tubes with angular progression described above, efficiently eliminates the axial tensions between the tubes and the shell.

Within the frame of the invention one can also allow the blind tube to be fully free floating without being connected to either of the tube plates.

The turning of the concentric circles of tubes need not be guided over the tube length, because at the turning of a circle of tubes a more or less automatic straightening of the tube bundle is achieved.

In order to connect the rings of tubes to a tube plate mandrals of a suitable shape are pressed into the tubes. This can be done in one step or in consecutive steps. For instance, one step for each ring to a configuration as shown at $1^1$ and $2^1$ in FIG. 2. The tubes are widened sufficiently to allow the solder to give a good connection. This soldering can be carried out by a robot. Since copper is the most commonly used material this shapening of the tube ends will not constitute any problem. In case the different rings of tubes are angled or turned separately and then mounted together, the shaping of the ends can take place before the different layers of tubes are mounted together; but preferably the shaping can be carried out on the tube core as a unit. The mandrels used to widen the tubes are preferably prismatically chamfered or diminish towards their front end in order to give a soft shaping of the tubes. The turning of the tubes as well as the shaping of the tube ends can be carried out by hydraulic, mechanical or other means.

In FIGS. 3–5 an embodiment of a heating device based on invention is shown for the use of the separate houses in a municipal heating network. The exchanger device mainly is constituted of four heat exchangers as described above. Two of these heat exchangers 20, 21 are coupled in series with an opposed flow direction for heating the water in a heating system of a house. The other two heat exchangers 22 and 23 are used to heat the hot water going to taps in the houses. An additional connection allows circulation of the hot water in the house, insuring that hot water is swiftly obtained at each tap in the house.

As is obvious from FIG. 3 the use of the heat exchangers as described above and in accordance with the invention give a rather simple total layout of a heating network. In FIGS. 4 and 5 is shown how really compact this device becomes when the heat exchangers are placed close to each other. The resulting device is compact, with a minimum of outlets and inlets simplifying the mounting thereof and also reducing the risk of mistakes.

From the above it is apparent how easily the heat exchanger according to the invention can be coupled in parallel or series in adaption to different capacity requirements etc.

What is claimed is:

1. A heat exchanger for transferring heat between an inner and outer medium comprising:

a bundle of tubes for allowing a flow of said inner medium therethrough, the tubes of said bundle being grouped in concentric rings, said rings having different diameters from one another over their entire length, the length of a ring including ends of the tubes within the ring, said tubes having angular progressions for avoiding fatal mechanical tensions caused by variations in the temperature of at least one of the inner and outer medium, and said tubes being corrugated along their entire length for allowing a turbulent flow of the outer medium between adjacent tubes, said bundle being so compact that at least one pair of adjacent tubes in adjacent rings are in contact with one another;

a shell surrounding said tube bundle;

inner medium connector means for transporting said inner medium to and from said tube bundle; and outer medium connector means for transporting said outer medium to and from said shell, said outer medium flowing around said tube bundle inside said shell.

2. The heat exchanger according to claim 1, wherein said rings have different angular progressions.

3. The heat exchanger according to claim 2, wherein said tubes are of equal length.

4. The heat exchanger according to claim 1, wherein ends of said tubes are fused to each other.

5. The heat exchanger according to claim 4, wherein a diameter of said bundle is substantially the same the entire length of said bundle.

6. The heat exchanger according to claim 1, wherein said tubes angularly progress around an axial tube at a center of said bundle.

7. The heat exchanger according to claim 1, wherein said bundle is so compact that at least one pair of adjacent tubes within a ring are in contact.

8. A heat exchanger for transferring heat between an inner and outer medium comprising:

a bundle of tubes for allowing a flow of said inner medium therethrough, the tubes of said bundle being grouped in concentric rings, said rings having different diameters from one another over their entire length, the length of a ring including ends of the tubes within the ring, said tubes having angular progressions and being corrugated, and outer rings of tubes being wound directly on inner rings of tubes;

a shell surrounding said tube bundle;

inner medium connector means for transporting said inner medium to and from said tube bundle; and outer medium connector means for transporting said outer medium to and from said shell, said outer medium flowing around said tube bundle inside said shell.

9. A heat exchanger for transferring heat between an inner and outer medium comprising:

a bundle of tubes for allowing a flow of said inner medium therethrough, the tubes of said bundle being grouped in concentric rings, said tubes having angular progressions for avoiding fatal mechanical tenions caused by variations in the temperature of at least one of the inner and outer medium, and said tubes being corrugated along their entire length for allowing a turbulent flow of the outer medium between adjacent tubes, said bundle being so compact that at least one pair of adjacent tubes in adjacent rings are in contact with one another and that at least one pair of adjacent tubes within a ring are in contact with one another;

a shell surrounding said tube bundle;

inner medium connector means for transporting said inner medium to and from said tube bundle; and outer medium connector means for transporting said outer medium to and from said shell, said outer medium flowing around said tube bundle inside said shell.

10. The heat exchanger according to claim 9, wherein said rings have different angular progressions.

11. The heat exchanger according to claim 10, wherein said tubes are of equal length.

12. The heat exchanger according to claim 9, wherein ends of said tubes are fused to each other.

13. The heat exchanger according to claim 12, wherein a diameter of said bundle is substantially the same the entire length of said bundle.

14. The heat exchanger according to claim 9, wherein said tubes angularly progress around an axial tube at a center of said bundle.

15. A heat exchanger for transferring heat between an inner and outer medium comprising:

a bundle of tubes for allowing a flow of said inner medium therethrough, the tubes of said bundle being grouped in concentric rings, said tubes having angular progressions and being corrugated, outer rings of tubes being wound directly on inner rings of tubes, said bundle being so compact that at least one pair of adjacent tubes within a ring are in contact with one another;

a shell surrounding said tube bundle;

inner medium connector means for transporting said inner medium to and from said tube bundle; and outer medium connector means for transporting said outer medium to and from said shell, said outer medium flowing around said tube bundle inside said shell.

* * * * *